US005786666A

United States Patent [19]

Lauf et al.

[11] Patent Number: 5,786,666

[45] Date of Patent: Jul. 28, 1998

[54] COLLECTOR SURFACE FOR A MICROWAVE TUBE COMPRISING A CARBON-BONDED CARBON-FIBER COMPOSITE

[75] Inventors: Robert J. Lauf, Oak Ridge; April D. McMillan, Knoxville, both of Tenn.; Arvid C. Johnson, Lake in the Hills, Ill.; Arthur J. Moorhead, Knoxville, Tenn.

[73] Assignee: Lockheed Martin Energy Systems, Inc., Oak Ridge, Tenn.

[21] Appl. No.: 620,512

[22] Filed: Mar. 22, 1996

[51] Int. Cl.[6] ..... H01J 23/027

[52] U.S. Cl. ..... 315/5.38

[58] Field of Search ..... 315/5.38

[56] References Cited

U.S. PATENT DOCUMENTS

| | | | |
|---|---|---|---|
| 3,260,885 | 7/1966 | Crapuchettes | 315/5.38 |
| 3,549,930 | 12/1970 | Katz | 315/5.38 X |
| 3,973,157 | 8/1976 | Giorgi et al. | 315/5.38 X |
| 4,417,175 | 11/1983 | Curren et al. | 315/5.38 |
| 4,527,092 | 7/1985 | Ebihara | 315/5.38 |
| 4,607,193 | 8/1986 | Curren et al. | 315/5.38 |
| 5,243,464 | 9/1993 | Lauf | 359/614 |
| 5,313,325 | 5/1994 | Lauf | 359/614 |

FOREIGN PATENT DOCUMENTS

| | | | |
|---|---|---|---|
| 218739 | 11/1985 | Japan | 315/5.38 |

OTHER PUBLICATIONS

A. N. Curren and K. A. Jensen, "Textured Carbon on Copper: A Novel Surface with Extremely Low Secondary Electron Emission Characteristics," NASA Technical Paper 2543, Dec. 1985.

G. C. Wei and J M Robbins, "Development and Characterization of CBCF Insulation for Radioisotope Space Power Systems," *ORNL/TM*-9381 (1985).

A. N. Curren and T. A. Fox, "Traveling-Wave Tube Efficiency Improvement wth Textured Pyrolytic Graphite Multistage Depressed Collector Electrodes," *IEEE Electron Device Lett.*, vol. EDL-2, #10, Oct. 1981, pp. 252-254.

*Primary Examiner*—Benny T. Lee

*Attorney, Agent, or Firm*—James M. Spicer

[57] ABSTRACT

In a microwave tube, an improved collector surface coating comprises a porous carbon composite material, preferably a carbon-bonded carbon fiber composite having a bulk density less than about 2 g/cc. Installation of the coating is readily adaptable as part of the tube manufacturing process.

4 Claims, 4 Drawing Sheets

COLLECTOR SURFACE FOR A MICROWAVE TUBE COMPRISING A CARBON-BONDED CARBON-FIBER COMPOSITE

This invention was made with Government support under contract DEAC05-84OR21400 awarded by the Office of Energy Efficiency and Renewable Energy, U.S. Department of Energy to Lockheed Martin Energy Systems, Inc. The Government has certain rights in the invention.

FIELD OF THE INVENTION

This invention relates to the field of microwave radiation production. More specifically, it relates to improved microwave electron tubes having higher efficiency produced by the suppression of secondary electron emission from the electron collector surfaces.

BACKGROUND OF THE INVENTION

The development of high-efficiency microwave devices such as traveling wave tubes (TWT) requires that high collector efficiency be achieved. The invention of the so-called multi-stage depressed collector (MDC) for these tubes has been a major contribution to this effort (A. N. Curren and T. A. Fox, "Traveling-Wave Tube Efficiency Improvement with Textured Pyrolytic Graphite Multistage Depressed Collector Electrodes", IEEE Electron Device Lett., vol EDL-2, no. 10, October 1981, pp. 252–254). In order to maximize the efficiency of MDCs, it is desirable to use electrode materials that have low secondary electron emission characteristics. Specifically, in order to recover the maximum kinetic energy from the spent electron beam after it has exited the radio-frequency interaction section of the TWT and entered the MDC, the electrodes must have low secondary electron emission characteristics.

A number of methods have been proposed that modestly lower secondary electron emission. These include coating the surface with compounds such as titanium carbide (TiC) whose emission characteristics are lower than that of the copper itself, and/or roughening the copper electrode surfaces. Some forms of graphite or carbon have also been tried. These include pyrolytic graphite, highpurity isotropic graphite, and ion-textured graphite. Another approach has been to sputter-deposit a thin, highly textured layer of carbon onto the copper. These methods are summarized in a recent report (A. N. Curran, and K. A. Jensen, "Textured Carbon on Copper: A Novel Surface With Extremely Low Secondary Electron Emission Characteristics," NASA Technical Paper 2543, 1985).

Each of the aforementioned methods has disadvantages that limit the use or increase the cost of multi-stage depressed collectors, with resulting increased cost and complexity of the manufactured TWTs, etc. For example, the use of sputter coating requires investment in the coating equipment, and the technique is relatively difficult to adapt to complex shapes and internal surfaces. The sputter coating is also very thin and fragile. In another example, the use of monolithic graphite electrodes has not been adopted because of the difficulty of brazing or joining them to the other components in TWTs. Also, in many of its forms, graphite is difficult to outgas, which makes it virtually impossible or impractical to maintain an acceptable vacuum within the tube.

SUMMARY OF THE INVENTION

Accordingly, it is a first object of this invention to provide means for fabricating an electron collector having reduced secondary electron emission characteristics.

Another object of the invention is to provide means for fabricating an electron collector having better heat transfer characteristics between the low-emission surface and the collector body.

Another object of the invention is to provide a multistage depressed collector having improved efficiency.

Still another object of the invention is to provide a method of manufacturing a microwave electron device having a multistage depressed collector with improved efficiency.

Yet another object of the invention is to provide a microwave tube having greater efficiency and power.

In accordance with one aspect of the present invention, the foregoing and other objects are achieved by a microwave electron device which comprises an electron source, an electron optical path, and an electron collector, the collector having a porous carbon bonded carbon fiber composite material affixed to at least one surface thereof.

In accordance with a second aspect of this invention, a method for making a microwave electron device comprises the steps of making a porous carbon composite body, machining the carbon body to a desired shape, machining a metal collector electrode, and affixing the machined carbon composite to at least one surface of the metal collector electrode.

Further and other aspects of the present invention will become apparent from the description contained herein.

BRIEF DESCRIPTION OF THE DRAWINGS

In the wings.

DETAILED DESCRIPTION OF THE PREFERRED EMBODIMENT

Requisite to the present invention is the capability of affixing a low electron emission material to selected interior surfaces of the electron collector in microwave vacuum devices such as TWTs, klystrons, gyrotrons, extended-interaction oscillators, etc. Preferably, the low electron emission material is low-density carbon-bonded carbon-fiber (CBCF) composite, the electron collector material is copper, and the two are bonded by vacuum brazing. The bonding is performed in a two-step operation described in our U.S. pat. No. 5,648,180 copending issned Jul. 15, 1997, entitled "Method for Joining Carbon—Carbon Composites to Metals", incorporated herein by reference in its entirety.

Briefly, the two-step brazing operation described in our Pat. No. 5,648,180 involves first sealing the surface of the CBCF composite to prevent infiltration of the braze alloy into the CBCF body. Sealing is accomplished by applying a coating of pitch or resin to the CBCF composite, and carbonizing this coating to yield a completely carbonaceous yet impermeable surface layer on the CBCF. The braze alloy composition and melting temperature are such that the braze joint will not be adversely affected by subsequent brazing operations as the vacuum envelope is assembled.

In our preferred embodiment, low-density carbon-borded carbon-fiber composite is machined to desired dimensions, and then brazed onto selected surfaces of the collector, which is preferably copper.

A strong brazed joint is produced that allows the CBCF to be further machined after attachment to the collector (if desired). After brazing, the entire collector assembly is brazed into the other tube components to form the complete vacuum envelope of the device.

EXAMPLE I

Helix Travelling Wave Tube With Single Stage Collector

Figure 1:
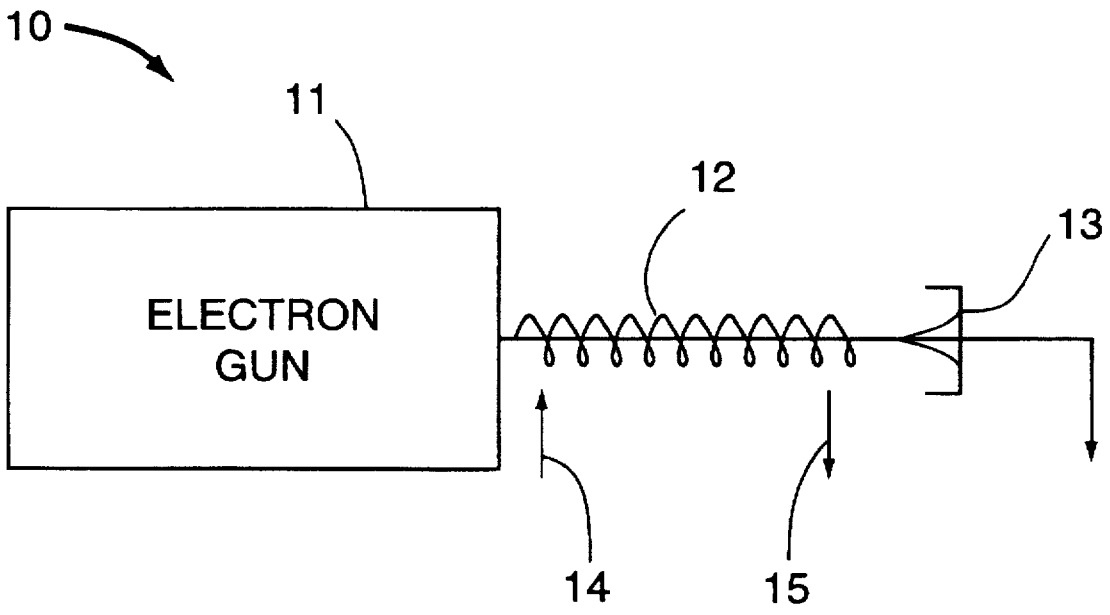
FIG. 1 (PRIOR ART)
FIG. 1 is a cross-sectional diagram of a conventioned helix traveling wave tube (TWT).

In the conventional helix travelling wave tube (TWT) shown at 10 in FIG. 1, electrons indicated by a heavy arrow emitted from the gun 11 travel axially in the form of a bacused bean through an interaction area in which they interact with a traveling electromagnetic field carried by the helix slow-wave circuit 12. The spent electron, shown devergena as it leaves the optical path, beam is collected at the collector 13. An RF signal input at 14 is amplified and outputted at 15. The collector 13 is typically made of copper in order to achieve good electrical and thermal conduction. However, secondary electrons emitted from the copper surface during bombardment by the spent electron beam can interfere with the electron optics and thereby limit the degree to which the collector can be operated at a depressed potential.

Figure 2:
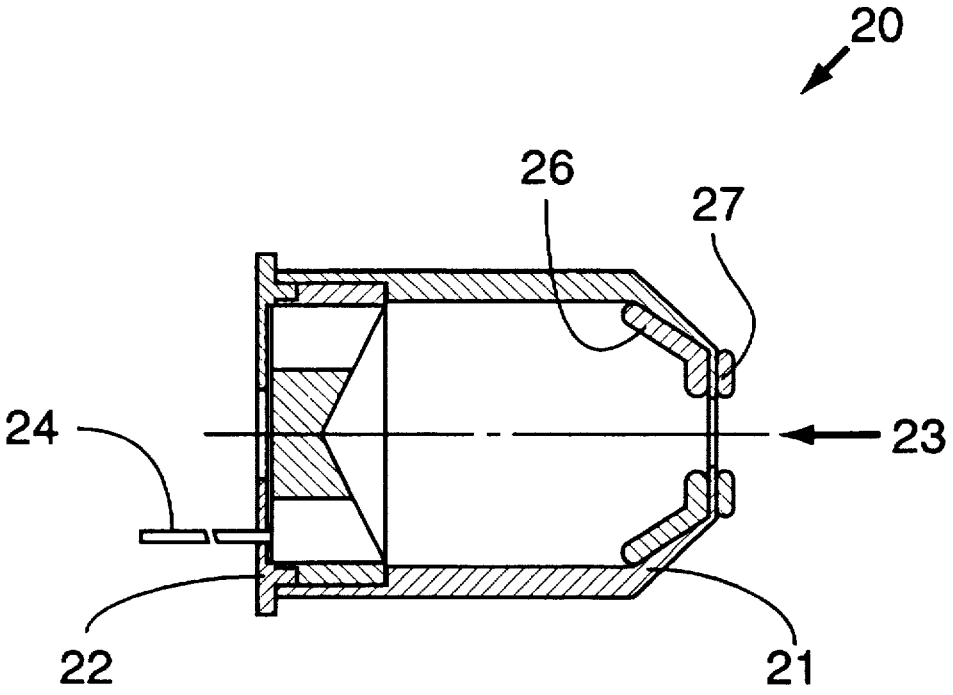
FIG. 2 is a cross-sectional diagram of a single-stage collector for a TWT along th TWT's center axis illustrating the placement of carbon-bonded carbon-fiber composite on the collector body.

FIG. 2 shows a typical single-stage collector 20 for the helix TWT of FIG. 1. FIG. 2 depicts the collector body 21 and incoming electron beam 23. The end 22 of the collector may contain a vacuum port 24 for pumping air from the tube during assembly. The vacuum port 24 is then sealed by crimping and brazing. In a preferred embodiment of our invention, shaped pieces of low-density carbon-bonded carbon-fiber composite are vacuum brazed to various parts of the collector body 21 in the areas shown at 26 and 27.

Figure 4:
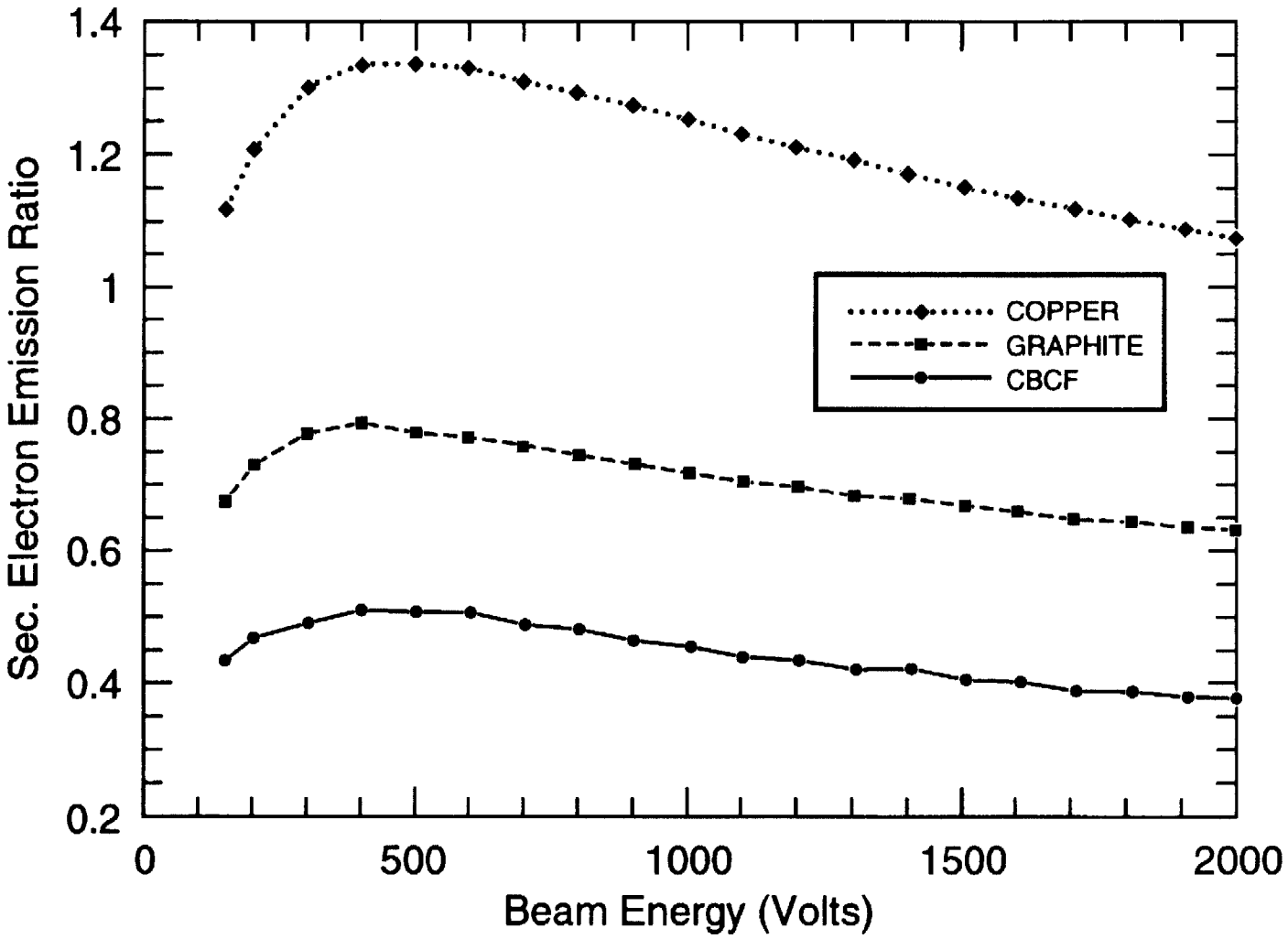
FIG. 4 is a plot of secondary electron emission ratio vs primary electron beam energy, comparing the carbon-bonded carbon-fiber composite with both copper and bulk graphite

The CBCF composite has favorable secondary electron emission characteristics owing to its low atomic number, low density, and the fact that the interconnected pore spaces provide additional trapping for many secondary electrons that are emitted within the pore structures. FIG. 4 shows the results of testing CBCF vs copper and graphite. The data clearly show that CBCF is 2.7 times better than bare copper and 1.6 times better than dense graphite in terms of secondary electron yield for all primary beam energies tested up to 10 kV. Furthermore, because the CBCF composite 21 depicted in FIG. 2 is manufactured by processing at very high temperatures in vacuum, it is thoroughly outgassed.

EXAMPLE II

Helix Travelling Wave Tube with Multi-Stage Collector

Figure 3:
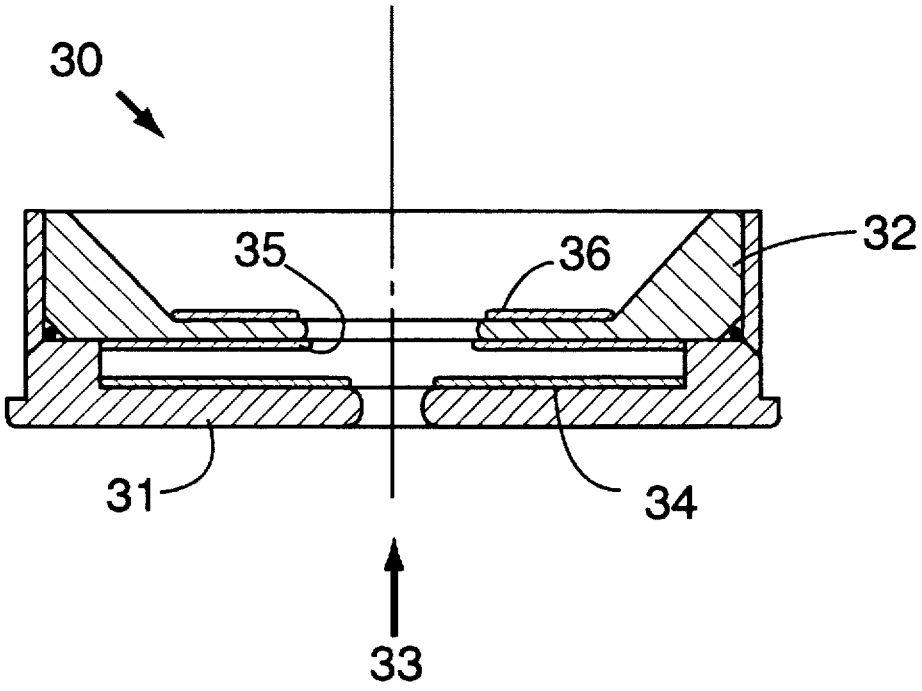
FIG. 3 is a cross-sectional diagram of a multistage collector for a TWT along the TWT's center axis illustrating the placement of carbon-bonded carbon-fiber composite on the collector stages

The front end of a typical multi-stage collector for the helix TWT of FIG. 1 is shown at 30 in FIG. 3, where 31 and 32 represent the two collector stages, and 33 represents the incoming electron beam.

In FIG. 3, shaped pieces of low-density carbon-bonded carbon-fiber composite are affixed to the collector stages 31 and 32 in the areas shown at 34, 35, 36. As in the single-stage collector in the previous example, the CBCF composite provides areas of low secondary electron emission, which allow greater depression of the collector voltage and therefore higher tube operating efficiency.

Those skilled in the art of microwave electron tubes will appreciate that many other types of microwave tubes contain features in common with the helix TWT, namely, a focused electron gun, an electron beam defining an electron optical path traversing an interaction cavity, and a metal collector for the spent electron beam. Some microwave tubes sharing these characteristics are the klystron, klystrode, gyrotron, coupled-cavity TWT, ring-loop TWT, ring-bar TWT, extended interaction oscillator and others. All of these devices can, in principle, be improved by the use of carbon-bonded carbon-fiber composite for reducing secondary electron emission from the collector surfaces. Furthermore, all of the aforementioned tubes are manufactured by substantially similar processes, including brazing of the vacuum envelope, so our inventive may be easily incorporated into conventional manufacturing operations.

This invention, then, makes it possible for low density CBCF composite, which is relatively inexpensive and easily machined to close tolerances, to be securely brazed onto the collector surfaces of various microwave electron tubes. The CBCF composite reduces secondary electron emission which improves the power and efficiency of the electron tubes. Brazing gives good thermal and electrical contact with the copper collector and is compatible with subsequent assembly steps of the electron tubes.

While there has been shown and described what are at present considered the preferred embodiments of the invention, it will be obvious to those skilled in the art that various changes and modifications can be made therein without departing from the scope of the inventions defined by the appended claims.

We claim:

1. In a microwave electron device having at least: an electron source; a focused electron beam originating at said source and defining an electron optical path; and a copper collector for collecting said electron beam; an improvement comprising:

vacuun brazed a shaped carbon-bonded carbon-fiber composite body to at least one surface of said electron copper collector for reducing the emission of secondary electrons from said surface due to the impingement of said electron beam thereon, said shaped carbon-bonded carbon-fiber composite body having one substantially impermeable surface, said substantially impermeable surface being the surface that is vacuum brazed to said at least one surface of said copper collector.

2. The microwave electron device of claim 1 wherein said copper collector is a multistage depressed collector.

3. The microwave electron device of claim 2 wherein at least two collector stages of said multistage depressed collectors each stage has a respective shaped carbon-bonded carbon-fiber composite body vacuum brazed to at least one surface thereof.

4. The microwave electron device of claim 1 wherein said electron copper collector is a single-stage collector.

* * * * *